US006345391B1

(12) United States Patent
Somers

(10) Patent No.: US 6,345,391 B1
(45) **Date of Patent: *Feb. 12, 2002**

(54) WRAP-AROUND AND WATERPROOF SEAT APPAREL FOR OUTDOOR APPLICATIONS

(76) Inventor: Jeffrey H. Somers, 28953 Dixboro Rd., South Lyon, MI (US) 48178

( * ) Notice: Subject to any disclaimer, the term of this patent is extended or adjusted under 35 U.S.C. 154(b) by 0 days.

This patent is subject to a terminal disclaimer.

(21) Appl. No.: 09/723,493

(22) Filed: Nov. 28, 2000

Related U.S. Application Data

(63) Continuation-in-part of application No. 09/503,311, filed on Feb. 14, 2000, now Pat. No. 6,175,959.

(51) Int. Cl.[7] ..... A41D 27/12
(52) U.S. Cl. ..... 2/46; 2/69
(58) Field of Search ..... 2/46, 69, 227, 2/238, 228, 232, 48, 44, 24, 1, 455, 456, 466, 267

(56) References Cited

U.S. PATENT DOCUMENTS

| | | | |
|---|---|---|---|
| 4,689,829 | A | 9/1987 | Kaplan |
| 4,735,423 | A | 4/1988 | Foss |
| 4,837,859 | A | 6/1989 | Hamberg |
| 4,993,077 | A | 2/1991 | Robison |
| 5,003,634 | A | 4/1991 | Brinkman |
| 5,068,920 | A | 12/1991 | Bray |
| 5,241,706 | A | 9/1993 | Netz |
| 5,282,277 | A | 2/1994 | Onozawa |
| 5,359,731 | A | 11/1994 | Cavalier |
| 5,386,603 | A | 2/1995 | Drust |
| 5,414,881 | A | 5/1995 | Terrazas |
| 5,625,895 | A | 5/1997 | Sovereign |
| D392,089 | S | 3/1998 | Draper |
| 5,740,566 | A | 4/1998 | Stacy |
| 5,740,567 | A | 4/1998 | Mitchell |
| 5,787,502 | A | 8/1998 | Middleton |
| 5,871,132 | A | 2/1999 | Hargreaves |
| 5,896,582 | A | 4/1999 | Baacke et al. |
| D415,335 | S | 10/1999 | Castiglione |
| 6,175,959 | B1 * | 1/2001 | Somers ..... 2/46 |

* cited by examiner

*Primary Examiner*—Gloria M. Hale
(74) *Attorney, Agent, or Firm*—Gifford, Krass, Groh, Sprinkle, Anderson & Citkowski, P.C.

(57) ABSTRACT

A wrap around article capable of being donned by a user engaged in outdoor pursuits including a main body having top, side and bottom edges defining a substantially square shaped configuration and which is constructed of a durable and waterproof material such as neoprene with an interior cushioning foam material. A main belt is secured in proximity to the top edge of the article and first and second pairs of legging straps are secured, respectively, to locations proximate the bottom edge of the article. Both the main belt and legging straps each further include interengaging members typically provided as snap fit members forming terminating portions of an adjustable main belt and releasably interengaging hook and loop fastener attachment portions for comfortably securing the article to the buttocks and upper legs of the user. The article is configured so that it conforms comfortably to the buttocks and about the upper legs of the user while providing the user a significant degree of movability. Additional interengaging portions permit the pairs of straps to adhere against the main body when the article is not in use.

6 Claims, 3 Drawing Sheets

WRAP-AROUND AND WATERPROOF SEAT APPAREL FOR OUTDOOR APPLICATIONS

CROSS REFERENCE TO RELATED APPLICATIONS

The present application is a continuation-in-part of U.S. application Ser. No. 09/503,311, filed Feb. 14, 2000, now U.S. Pat. No. 6,175,959 a Wrap-around and Waterproof Seat Apparel for Outdoor Applications.

BACKGROUND OF THE INVENTION

1. Field of the Invention

The present invention relates generally to seat or pant insulating and waterproofing devices and, more particularly, to a convenient wrap-around and waterproof article of apparel which can be quickly applied over the user's conventional outdoor clothing and which provides a measured degree of both waterproof resistance when the user is in a seated position during the outdoor activity, as well as a degree of insulating warmth.

2. Description of the Prior Art

Various types of insulating and, to some extent, waterproofing, seat materials are known in the art and for use in outdoor activities. A first example of such a device is set forth in U.S. Pat. No. 5,625,895, issued to Sovereign, and which discloses a garment for protecting the buttocks of a wearer when seated.

Sovereign includes a waist band with a rectangular pad depending downwardly from a rear of the waist band and having a width which extends around the rear of the wearer and downwardly beyond the wearer's crotch. A utility pocket is provided on an inner or front surface of the pad and so that the pocket is arranged forwardly and between the legs of the user when the user is seated. On the outside of the pad is provided a transparent plastic cover defining a pocket for receiving printed information such as a sports logo and the pocket is closable by pulling the waist band around the waist of the user.

While providing an interesting disclosure, it is noted that the device of Sovereign likely has certain limitations to the size of individual to which it can be applied by virtue of its construction. Furthermore, the incorporation of multiple layers of material, including the inner fleece layer, the layer of foam material, and the outer waterproof layer, tend to add bulkiness to the article. It has been also found that, once the outer waterproof layer inevitably becomes ripped, torn or snagged due to persistent outdoor use, the inner layers of a device such as Sovereign will quickly become waterlogged and compromised, thus rendering them ineffective for their intended tasks.

U.S. Pat. No. 5,003,634, issued to Brinkman, teaches a belt type garment with foldable seat cover and having straps projecting from opposing ends of a pouch secured about a user's waist. An elongate opening formed in the pouch is positioned above the user's seat and is releasably closed by two separate (inner and outer) zippers. An elongate panel or sheet of flexible, waterproof material is secured at one end of one edge of the pouch opening to extend downwardly out of one (outer) zipper into an operative position beneath one's seat. The panel or sheet may then be secured in place by two other straps which fasten around the legs of the user. The inner zipper may be closed to retain personal items in the pouch. When not in use, the waterproof panel is rolled up and stored in the pouch.

While providing an effective article, Brinkman includes a substantially rectangular and uniform cover section with only a first and second strap extending from opposite edges of the cover section. The further fact that the straps extend from proximately the outer opposite edges, rather than from more central locations of the panel of material, causes to provide a lesser degree of support to the user. Accordingly, the device of Brinkman tends to become very cumbersome and bulky when worn by a user, in that it restricts the freedom of motion of the user's legs and due to the tendency of the user to want to be able to move about with the upper portion of one leg in varying differing positions relative to the other leg, such usually being the case when climbing or scaling upon outdoor obstacles (trees, shrubs, hills, etc.). Accordingly, Brinkman would in reality be fairly limiting in actual applications.

U.S. Pat. No. 4,837,859, issued to Hamberg, discloses a supplementary clothing article suitable for outdoor use and which provides an insulated area between a user and a substrate surface, such as a cold surface. The article is adapted to be worn about a user's torso in a folded condition when not in use. The article is composed of a plurality of pad members each including a layer of mat insulating material provided with an outer covering of a textile material and a flexible connection forming a fold area between adjacently located pad members. Also included are a pair of spaced-apart flexible strap means, one of which is located near the upper end of an upper-most pad member and the other being near an upper end of a lower-most pad member for encircling a wearer's torso at the waist when the article is in a folded form or in use and so that the strap means encircle the lower torso in the region of the user's legs. Applicant's best understanding of Hamberg therefore is that it does not teach or suggest the provision of dedicated pairs of straps for securing about the first and second legs of the user and apart from additional straps for engaging around the user's waist or lower torso.

U.S. Pat. No. 5,241,706, issued to Netz, teaches a garment convertible from a muffler to a seat warmer and which includes a foldable pad which can be unfolded, worn about the waist of the user, and worn over and below the rear buttocks of the user, thereby serving as a seat. The pad can also be folded and secured in its folded state to define a space within for receiving the hands of the user, strapped to the waist of the user, and worn in front of the user, thus serving as a muffler. The pad is preferably composed of three adjacent pads joined to one another to facilitate folding. The pad is also preferably insulated and constructed out of a waterproof material, thus permitting its use under a wide variety of weather conditions.

Finally, U.S. Pat. No. 4,735,423, issued to Foss, discloses a flexible shield mountable on the rump of a user's body to protect the user from incurring bruises and abrasions while sliding down a hill. The shield includes a skid plate and adjustable straps for releasably attaching the skid plate to the rump of the user. The skid plate is further preferably a sheet of flexible plastic, substantially rectangular in form, and having a smooth posterior surface for sliding on snow or ice. A lower portion of the skid plate is bifurcated by a vertical slit to facilitate walking with the shield in place. A waist strap is inserted through slits in the left and right upper corners of the skid plate. Left and right leg straps secure the lower portion of the skid plate to the user's legs. A crotch strap is inserted through a slit in a flap in the lower central portion of the skid plate, the two ends of the crotch strap passing between the legs and being connected to the ends of the waist strap.

SUMMARY OF THE PRESENT INVENTION

The present invention is a wrap around article capable of being donned by a user engaged in outdoor pursuits and including an ergonomically configured main body having top, side and bottom edges and which is constructed of a durable and waterproof material such as neoprene with an interior cushioning foam material. A main belt is secured in proximity to the top edge of the article. First and second secondary straps are secured at specified locations proximate the bottom edge of the main body.

The main belt includes snap fit members forming terminating portions of adjustable first and second lengths. Releasably interengaging Velcro® attachment portions extend from ends of first and second pairs of fixed legging straps forming the first and second straps for comfortably securing the article to the buttocks and upper legs of the user. Additional interengaging attachment portions, typically again Velcro® portions, are provided in opposingly facing fashion between a front facing surface of the main body and selected legging straps and in order to maintain the legging straps in a substantially flush and adhering fashion against the front surface of the main body. Additional features include the employment of rivets to reinforce the integrity of the article.

A second preferred embodiment substitutes the substantially planar and square shaped cross section with first and second downwardly extending and arcuately configured legging portions. The purpose of the legging portions is to provide additional conformance of the article to the user's legs and buttocks. As with the first preferred embodiment, additional interengaging attachment portions are provided in opposingly fashion between the front facing surface of the main article body and selected legging straps and in order to maintain the legging straps in a substantially flush and adhering fashion against the front surface of the main body.

BRIEF DESCRIPTION OF THE DRAWINGS

Reference will now be made to the attached drawings, when read in combination with the following specification, wherein like reference numerals refer to like parts throughout the several views, and in which.

DETAILED DESCRIPTION OF THE PREFERRED EMBODIMENTS

Figure 1:
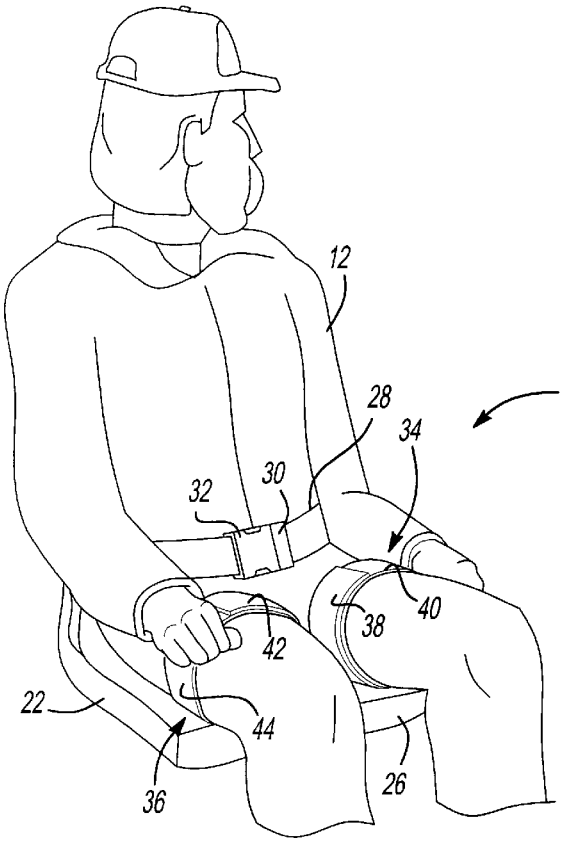
FIG. 1 is a perspective environmental view of the wrap-around and waterproof seat apparel article according to the present invention and showing it being worn by a user engaged in an outdoor activity.

Referring now to FIG. 1, a perspective environmental view is illustrated at 10 of the wrap-around and waterproof seat apparel article according to present invention and showing it being worn by a user 12 engaged in an outdoor. As will be further described in additional detail, it is understood that the wrap around article of the present invention can be employed in many and numerous outdoor applications, such as in hunting, fishing, skiing and in addition to outdoor spectator sports and the like. As will also be further described in additional detail, the purpose of the wrap around article of the instant invention is to provide the wearer with a quickly securable garment over the user's existing outerwear and which enables the user to primarily acquire a degree of water-resistance to the existing outerwear clothing and, furthermore a secondary and additional degree of thermally insulating protection afforded by the wrap around article.

Figure 2:
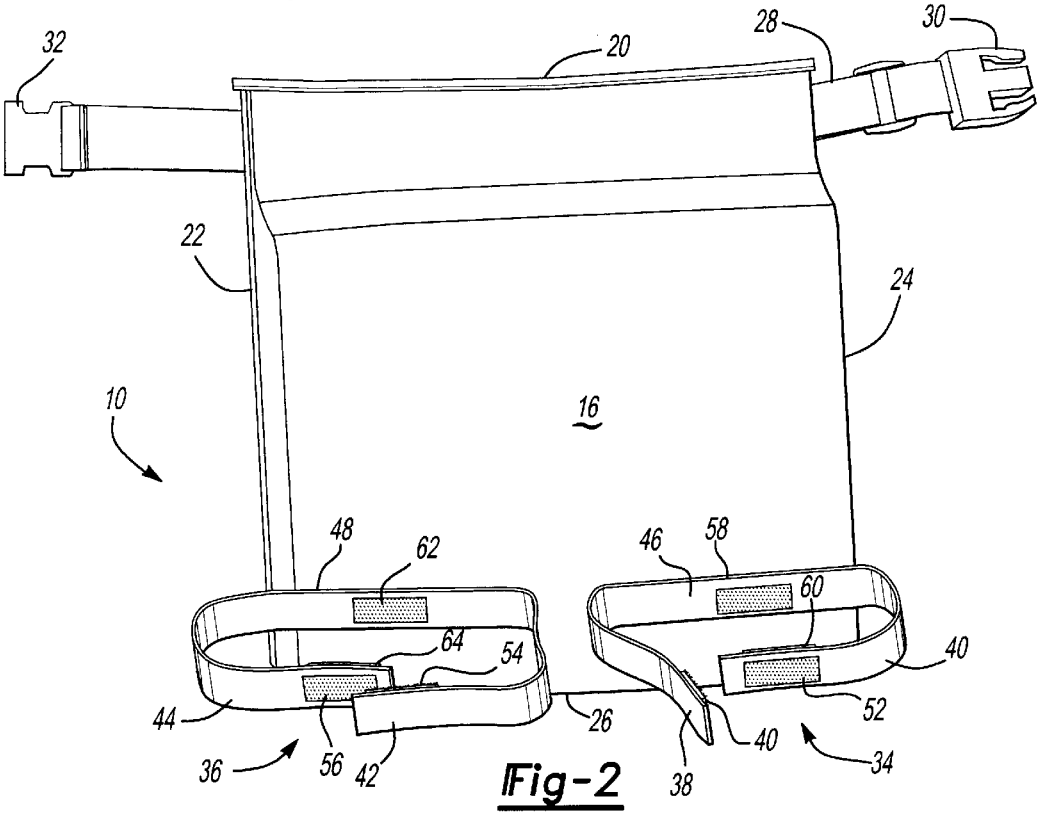
FIG. 2 is a frontal view of the seat apparel article and further illustrating the main interengaging belt incorporated proximate to the upper edge of the article and combined with the first and second pairs of legging straps with multiple interengaging portions.
Figure 3:
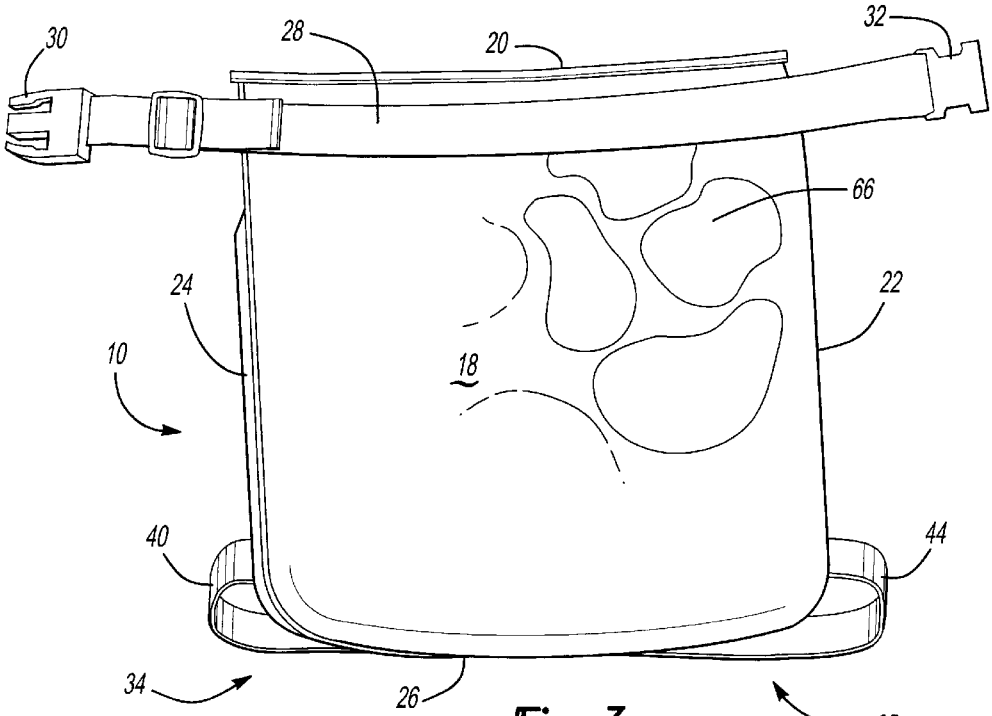
FIG. 3 is a reversed plan view of the seat apparel article and illustrating its outwardly or rear facing surfaces.

Referring additionally to FIGS. 2 and 3, first and second plan views are illustrated, respectively, of the seat apparel article 10 in 180° rotated positions. The article 10 is constructed of a substantially and ergonomically configured main body covering a given surface area and including a front facing surface 16 and a rear facing surface 18. The article 10 further includes a top edge 20, a first extending side edge 22, a second extending side edge 24, and a generally bottom extending edge 26 which define, in combination, a generally square shaped configuration. It is also contemplated that one or more of the edges of the article 10 may be notched or curved to further facilitate being ergonomically configured to the user's buttocks and upper legs, as is shown in FIG. 1, and so that the article can be comfortably worn during any outdoor activity.

A main interengaging belt 28 is incorporated proximate to the upper edge 20 of the article and, in the primary illustrated variation, is sewn against the front facing surface 16 and continuously extends from the opposite edges 22 and 24. The main belt 28 terminates at one end in a first releasably interlocking portion 30 and at the other end in a second interengaging and releasably interlocking portion 32. The interlocking portions 30 and 32 are by themselves fairly well known in the art and typically consist of snap connectors or the like for quickly and effectively securing and releasing the belt. The belt may further be adjustable, as is well known in the art, and can be constructed of a nylon material.

First 34 and second 36 pairs of legging straps extend from the front facing surface 16 of the main body. Specifically, the first pair 34 of legging straps includes a first outer strap portion 38 and a second inner strap portion 40. Similarly, the second pair 36 of legging straps includes a first outer strap portion 42 and a second inner strap portion 44. The strap portions 38, 40, 42 and 44 are, in the preferred embodiment, fixed elongated articles extending from the front facing surface 16 of the main body a selected distance from the bottom extending edge 26.

In the embodiment illustrated, the strap portions 38 and 40 are part of a single elongated strap and are separated by an intermediate portion 46 (see especially FIG. 2) sewn against the front facing surface 16 of the main body. Similarly, the strap portions 42 and 44 are separated by an intermediate portion 48 also sewn in a similar fashion against the front facing surface 16 of the main body. It is also contemplated that the pairs 34 and 36 of legging straps may be provided as individual pieces either secured directly to associated locations of the main body or, in some manufacturing embodiments, molded or integrally formed with the associated surface 16 of the main body, again provided that sufficient stitching or other suitable type of reinforcement is provided for maintaining the straps with the body during normal use of the article.

Each strap portion 38 and 40 (of first pair 34 of straps), as well as strap portions 42 and 44 (of second pair 36 of straps) terminates in a releasably engageable portion, these being such as are commercially known as Velcro® attachment portions. Specifically (and as is again best shown in FIG. 2), releasably engageable portions 50 and 52 are provided at opposing end locations of the strap portions 38 and 40, respectively, and additional releasably engageable portions 54 and 56 are provided at opposing end locations of the strap portions 42 and 44. The nature of the releasably engageable portions 50, 52, 54 and 56 is that it permits the associated strap portions 38, 40 and 42, 44 to be resecurably engaged against each other at specified and axially adjustable positions and so that, in cooperation with the interlocking portions 30 and 32 of the main belt 28, the article 10 may be comfortably fitted about the seat and upper legs of the user 12 (see again FIG. 1).

Figure 4:
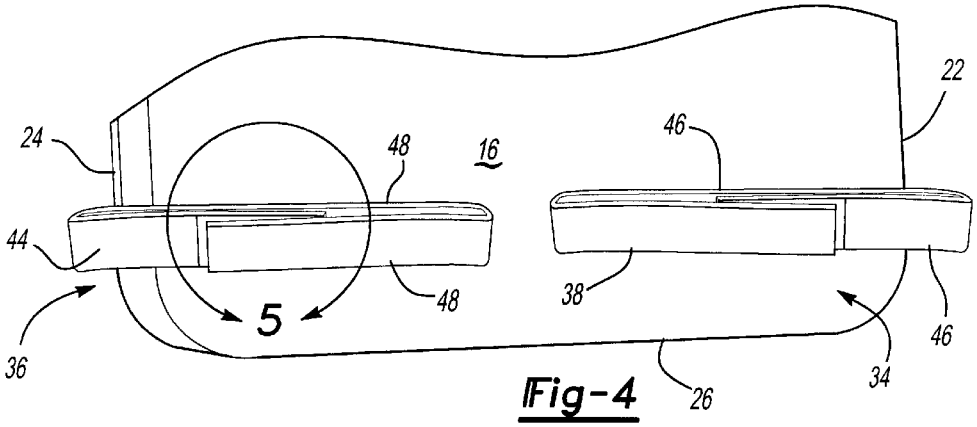
FIG. 4 is a lower sectional view of the first and second pairs of legging straps secured in a substantially flush and adhering fashion against the main body.
Figure 5:
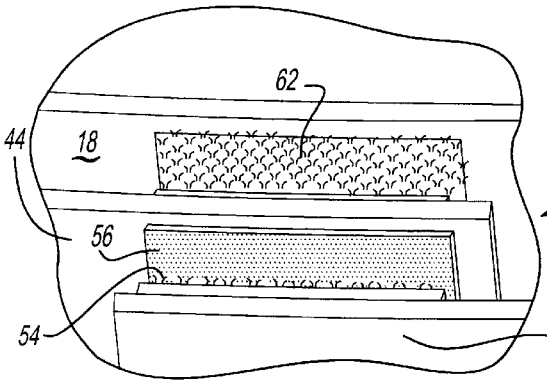
FIG. 5 is an enlarged sectional view of the successive interengaging portions arrayed between the associated pairs of legging straps, as well as between an inner-most arrayed strap and the main body.

Referring again to FIG. 2, as well as to FIGS. 4 and 5, additional releasably securing portions are shown for securing the strap portions 38, 40, 42 and 44 in adhering fashion against the front facing surface 16 of the article main body. Specifically, a releasably engageable portion 58 is secured upon the intermediate portion 46 of strap portions 38 and 40 and opposingly interengages a further engageable portion 60 placed upon a reverse face of the legging strap portion 40. Similarly, a releasably engageable portion 62 is secured upon the intermediate portion 48 of strap portions 42 and 44 and opposingly interengages a further engageable portion 64 placed upon a reverse face of the legging strap portion 44.

Reference is also made to the enlarged sectional view of FIG. 5 which further illustrates the successive arrangement of adhering the strap portions 42 and 44 to each other and, in turn, to the front facing surface 16 of the article. The purpose for adhering the legging straps to the face 16 of the article is to provide a neat and storable appearance to the article 10 when not in use. An additional benefit of the adhering straps is to facilitate transport of the article 10 from one place to another and to prevent the respective pairs 34 and 36 of legging straps (again illustrated respectively as strap portions 38, 40 and 42, 44) from becoming entangled.

As is further again shown in FIG. 1, the main belt 28 and pairs of legging straps 34 and 36 are engaged about the waist and upper leg portions, respectively, of the wearer 12 so that the article 10 is firmly fixed in place. The advantage, as previously stated, of the wearable article 10 is that it is capable of being quickly donned or removed and, combined with its ergonomic configuration, provides a fair degree of comfort and adaptability to user's of differing size.

The material content of the article 10 according to a preferred variant is constructed of a layer of a neoprene or like material and which provides the requisite qualities of water resistance and, to a lesser extent, thermal protection against the outside elements. It is also well understood that the outer layers of neoprene can be substituted by other types of materials, without departing from the scope of the invention, and in which such other materials exhibit the necessary properties of water resistance and, in some instances, additional thermal protection. It is also well known that the existing outerwear itself achieves greater levels of thermal insulating ability by maintain dryness, therefore the present invention achieves both objectives by primarily maintaining the dryness of clothing it is wrapped around by the user.

The present invention also contemplates providing an outer layer of neoprene combined with an interior layer of a foamable material to provide a degree of cushioning and seating support of the user as well as some additional thermal insulation. Reference is again had to the article illustrated at 10 in FIG. 1 and which displays a selected thickness. The advantages of utilizing an expanded plasticized or foamable type material as an inner layer includes the ability to construct the article 10 at a relatively lower cost and with less fabricating time, as well as the intrinsic characteristic of such materials to also repel water if by chance it permeates beyond the outer neoprene layers. Rivets (not shown) may also be provided at spaced locations and proximate the side edges 22 and 24 of the article 10 to provide the function of reinforcing the stitched or adhesive securement between the outer neoprene or other waterproofing layers and the central foamable material, such manner of securing the layers together being alternatively or cumulatively available.

Figure 6:
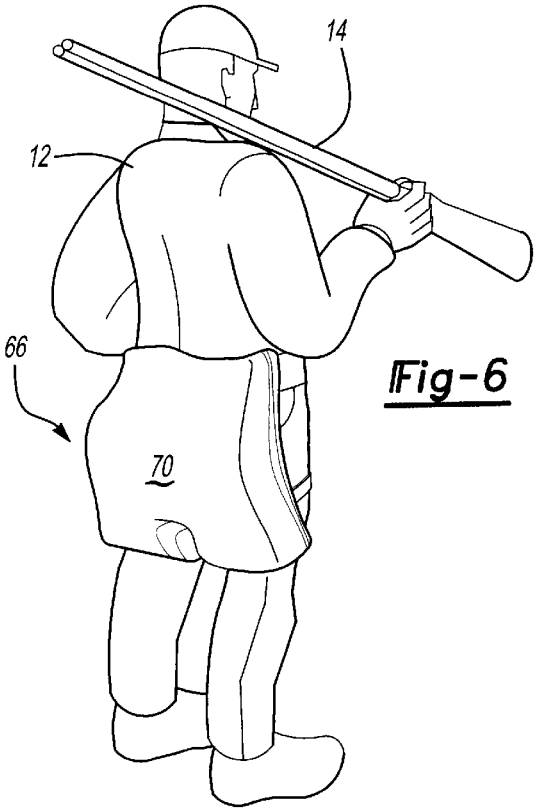
FIG. 6 is a further perspective environmental view of the wrap-around and waterproof seat apparel article according to a second preferred embodiment of the present invention.
Figure 7:
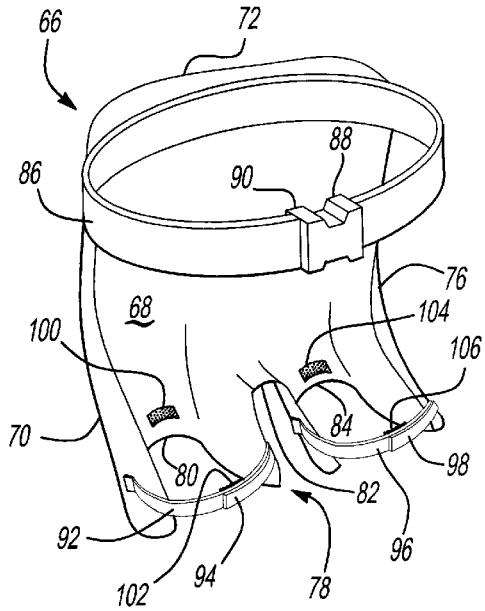
FIG. 7 is a further perspective view of the seat apparel article in a substantially 180° rotated position relative to FIG. 6 and showing the interengaging main belt and first and second downwardly extending legging portions with additional legging straps.

Referring now to FIG. 6, a perspective environmental view is illustrated at 66 of the wrap-around and waterproof seat apparel article according to a second preferred embodiment and showing it being worn by the user 12 engaged in an outdoor activity such as hunting which is implied by the fact that the user carries a firearm 14. Referring to FIG. 7, a further perspective and plan views are illustrated, respectively, of the seat apparel article 66 in substantially 180° rotated positions relative to the perspective of FIG. 1 and to reveal the inward surfaces of the article 66. In the preferred embodiment, the article 66 is constructed of a substantially and ergonomically configured main body covering a given surface area and including inner 68 and outer 70 facing surfaces. The article 10 further includes a top edge 72, a first extending side edge 74, a second extending side edge 76, and a generally bottom extending edge 78. The bottom extending edge 78 is further defined as including a first downwardly extending legging portion 80, a central arcuately recessed and split crotch portion 82 and a second downwardly extending legging portion 84. The main body portion, as evident from FIGS. 6 and 7 taken in combination, is also inwardly and arcuately angled along the first and second extending side edges 74 and 76, as well as the downwardly extending legging portions 80 and 84. The purpose for this is to assist in the ergonomic conforming of the article 66 to the user's buttocks and upper legs, as is shown in FIG. 1, and so that the article can be comfortably worn during any outdoor activity.

A main interengaging belt 86 is incorporated proximate to the upper edge 72 of the article and, in the primary illustrated variation, is sewn against the inner 68 facing surface and continuously extends from the opposite edges 74 and 76. The main belt 86 terminates at one end in a first releasably interlocking portion 88 and at the other end in a second interengaging and releasably interlocking portion 90. The interlocking portions 88 and 90 are by themselves fairly well known in the art and typically consist of snap connectors or the like for quickly and effectively securing and releasing the belt. The belt 86 may further be adjustable, as is well known in the art, and can be constructed of a nylon material.

Combined with the first 80 and second 84 downwardly extending legging portions are again the first and second pairs of legging straps as will again be described. Specifically, legging straps 92 and 94 extend from selected locations along the inner face 68 of the first legging portion 80 and, similarly, legging straps 96 and 98 extend from selected locations along the inner face of the second legging portion 84. Each strap again includes a releasably engageable portions, these being such as are commercially known as Velcro® attachment portions. The first and second pairs 92, 94 and 96, 98 are illustrated in interengaged fashion in FIGS. 6 and 7, accordingly the interengaging portions are hidden from view.

Referring again to FIG. 7, additional releasably securing portions are again shown for securing the strap portions 92, 94, 96 and 98 in adhering fashion against the front facing surface 16 of the article main body. Specifically, a releasably engageable portion 100 is secured upon the inner facing surface 68 of the article 66 in proximity to the first legging portion 80 and opposingly interengages a further engageable portion 102 placed upon a reverse face of the legging strap portion 92. Similarly, a releasably engageable portion 104 is secured upon the inner facing surface 68 of the article 66 in proximity to the second legging portion 84 and opposingly interengages a further engageable portion 106 placed upon a reverse face of the legging strap portion 96. When applied in the adhering, or "stow-away" fashion, the pairs of legging straps, 92, 94 and 96, 98 adapt to a configuration as substantially illustrated in the enlarged sectional view of FIG. 4 in the first preferred embodiment.

Figure 8:
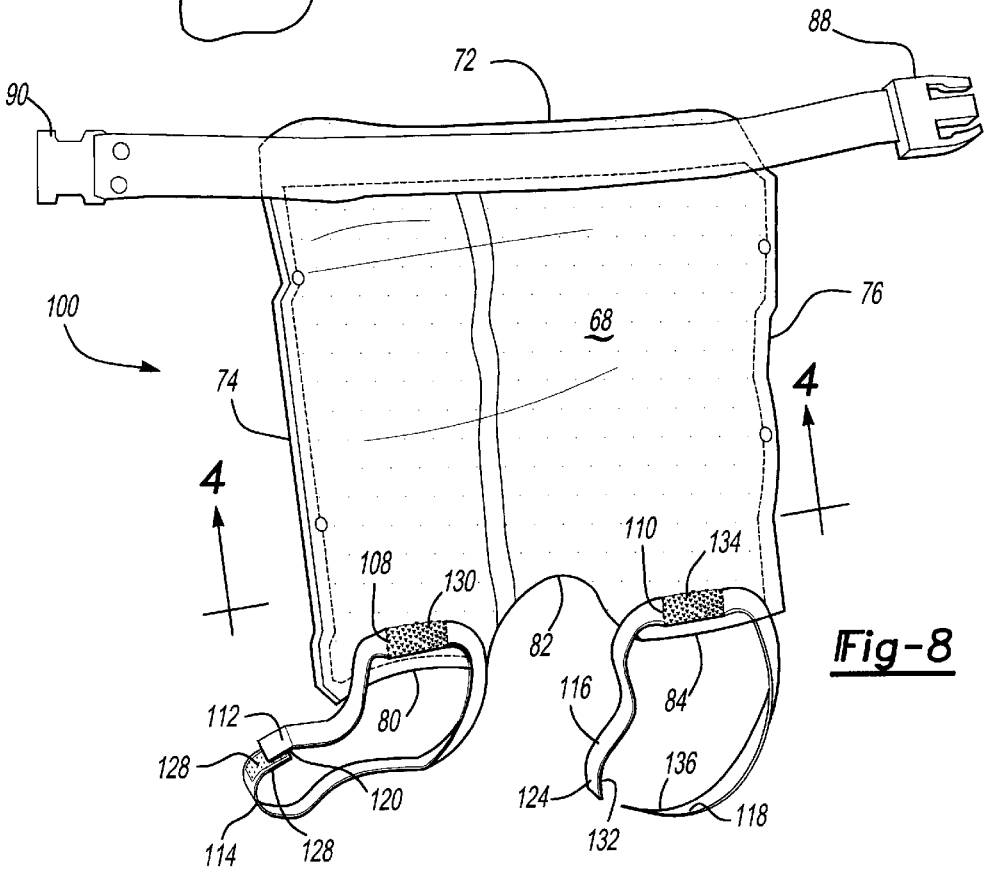
FIG. 8 is a further plan view, similar to that illustrated in FIG. 2 with respect to the first preferred embodiment, and showing a further configuration of the downwardly extending legging straps of the seat article according to the second preferred embodiment.

Referring finally to FIG. 8, a slightly further modified configuration 100 is illustrated of the seat article otherwise illustrated at 66 in FIGS. 6 and 7, and in which each pair of the legging straps is provided as a single strap (see at 108 and 110 for legging portions 80 and 84, respectively). A central portion of each strap 108 and 110 is sewn or otherwise secured to the inner facing surface 68 of the article 66 and the strap 108 includes extending ends 112 and 114, while the strap 110 includes extending ends 116 and 118. Pairs of interengaging portions 120 and 122 (strap ends 112 and 114) and 124 and 126 (strap ends 116 and 118) interengage to secure the strap portions about the legs of the user. Additional interengaging portions 128 and 130 (legging portion 80) and 132 and 134 (legging portion 84) adheringly engage the straps against the inner facing edge 68 of the reconfigured article 100 in the manner previously described.

Having described my invention, it will become apparent that it discloses a novel and useful wrap around article for numerous outdoor applications. Additional features include the ability to place numerous different types of colors and color schemes onto the exteriorly facing surfaces of the article and such as forest, snow or desert camouflage patterns (see at 66 in FIG. 3) for hunting, as well as any other solid colors or patterns corresponding to team logos. The wrap around article further provides many varied outdoor uses in which it is desirous to keep out exterior moisture and to maintain the dryness of the user's pants. Additional preferred embodiments will become apparent to those skilled in the art to which it pertains and without deviating from the scope of the appended claims.

I claim:

1. A wrap around article capable of being worn against the buttocks and upper legs of a user, said article comprising:

a main body extending over a given surface area and including a top edge, a first side edge, a second opposite side edge, and a generally extending bottom edge which define, in combination, a front facing surface and a rear facing surface, said body further being constructed of a material having a selected thickness and enclosing a cushioning material;

a main belt secured in proximity to said top edge of said main body, said belt including first and second ends which display, respectively, first and second interlocking portions;

first and second pairs of legging straps extending proximately from locations along said bottom edge, each of said straps further including an opposing and interengaging portion for securing said pairs of straps together; and additional opposing and interengaging portions arranged, respectively, upon said front facing surface of said main body and selected straps of said first and second pluralities of straps;

said article being positioned over the buttocks and adjoining upper legs of the user so that the main belt is adapted to being secured about the user's waist and said interengaging portions of said first and second straps are respectively secured about the upper legs, said additional interengaging portions adhering said straps against said main body when said article is not in use.

2. The wrap around article as described in claim 1, further comprising said article being configured to wrap around the buttocks and legs of the user.

3. The wrap around article as described in claim 1, further comprising said inner and outer facing surfaces further being constructed of a neoprene material.

4. The wrap around article as described in claim 1, further comprising a color scheme or camouflage pattern placeable upon the outer facing surface of the article.

5. A wrap around article capable of being worn against the buttocks and upper legs of a user, said article comprising:

a main body extending over a given surface area and including a top edge, a first side edge, a second opposite side edge, and a generally extending bottom edge which define, in combination, a substantially square shaped configuration with a front facing surface and a rear facing surface, said body further being constructed of a material having a selected thickness and enclosing a cushioning material;

a main belt secured in proximity to said top edge of said main body, said belt including first and second ends which display, respectively, first and second interlocking portions;

a first pair of legging straps including a first extending strap portion and a second extending strap portion, a second pair of legging straps also including a first extending strap portion and a second extending strap portion, said pairs of legging straps extending proximate from locations along said bottom edge, each of said strap portions further including an opposing and interengaging portion for securing each of said pairs of straps together; and additional opposing and interengaging portions arranged, respectively, upon said front facing surface of said main body, at first and second locations, and upon selected straps from said first and second pluralities of straps;

said article being positioned over the buttocks and adjoining upper legs of the user so that the main belt is adapted to being secured about the user's waist and said interengaging portions of said first and second straps are respectively secured about the upper legs, said additional interengaging portions adhering said straps against said main body when said article is not in use.

6. A wrap around article capable of being worn against the buttocks and upper legs of a user, said article comprising:

a main body extending over a given surface area and including a top edge, a first side edge, a second opposite side edge, and a generally extending bottom edge defining first and second legging portions, said main body further defining a front facing surface and a rear facing surface, said body further being constructed of a material having a selected thickness and enclosing a cushioning material;

a main belt secured in proximity to said top edge of said main body, said belt including first and second ends which display, respectively, first and second interlocking portions;

first and second pairs of legging straps extending proximately from locations along said bottom edge, each of said straps further including an opposing and interengaging portion for securing said pairs of straps together; and additional opposing and interengaging portions arranged, respectively, upon said front facing surface of said main body and selected straps of said first and second pluralities of straps;

said article being positioned over the buttocks and adjoining upper legs of the user so that the main belt is adapted to being secured about the user's waist and said interengaging portions of said first and second straps are respectively secured about the upper legs, said additional interengaging portions adhering said straps against said main body when said article is not in use.

* * * * *